United States Patent [19]

Bucci

[11] Patent Number: 4,683,864

[45] Date of Patent: Aug. 4, 1987

[54] FUEL ROUTING SYSTEMS FOR FUEL-INJECTED ENGINES

[75] Inventor: George H. Bucci, Tolland, Conn.

[73] Assignee: Whitehead Engineered Products, Inc., Meriden, Conn.

[21] Appl. No.: 722,253

[22] Filed: Apr. 11, 1985

[51] Int. Cl.[4] ..... F02M 39/00; B05D 7/01

[52] U.S. Cl. ..... 123/575; 123/198 DB; 123/514; 137/113; 137/255

[58] Field of Search ..... 123/575–578, 123/198 DB, 510, 516, 514; 137/255, 256, 113

[56] References Cited

U.S. PATENT DOCUMENTS

| | | | |
|---|---|---|---|
| 1,849,702 | 3/1932 | Bard | 137/113 |
| 1,854,317 | 4/1932 | Teesdale | 137/113 |
| 1,858,291 | 5/1932 | Burdett | 137/113 |
| 2,417,215 | 3/1947 | Satterlee | 137/255 |
| 2,768,640 | 10/1956 | Zimmer | 137/113 |
| 3,633,605 | 1/1972 | Smith | 137/113 |
| 3,658,081 | 4/1972 | Renaudie | 137/113 |
| 4,287,908 | 9/1981 | Storgard | 137/255 |
| 4,303,089 | 12/1981 | Gage | 137/113 |
| 4,386,625 | 6/1983 | Perkins | 137/255 |
| 4,502,453 | 3/1985 | Kabasin | 123/575 |
| 4,550,691 | 11/1985 | McWade | 123/575 |

*Primary Examiner*—Carl Stuart Miller

*Attorney, Agent, or Firm*—Maurice M. Klee

[57] ABSTRACT

Fuel routing apparatus for use with fuel-injected engines is provided. In accordance with certain of its aspects, the apparatus automatically recycles fuel to the vehicle's engine when the fuel stream from the vehicle's storage tank is interrupted. In accordance with other aspects, the apparatus provides automatic hydraulic switching between fuel tanks for multiple fuel tank vehicles. In certain preferred embodiments, the apparatus includes a replaceable fuel filter and provides automatic bleeding of entrained air from the fuel stream which is delivered to the vehicle's engine.

11 Claims, 12 Drawing Figures

FUEL ROUTING SYSTEMS FOR FUEL-INJECTED ENGINES

BACKGROUND OF THE INVENTION

1. Field of the Invention

This invention relates to fuel-injected gasoline engines and, in particular, to improved fuel routing systems for such engines.

2. Description of the Prior Art

In a fuel-injected gasoline engine, gasoline is supplied at a relatively high pressure to one or more injectors which are connected directly to the engine cylinders or to an intake manifold leading to the cylinders. A common configuration for delivering fuel to such engines uses two pumps: a low pressure pump either near or in the vehicle's gas tank and a high pressure pump connected to the injectors. For vehicles having two gas tanks, e.g., medium duty and larger trucks, off-road vehicles, and the like, an additional low pressure pump is used for the second tank.

For single tank systems employing the above configuration, two lines run between the gas tank and the injectors: a feed line which includes the low pressure pump, the high pressure pump, and at least one fuel filter, normally located between the low and high pressure pumps; and a return line which carries non-injected fuel back to the gas tank. Two tank systems include a feed and a return line for each tank and a selector valve for selecting the tank which is to supply fuel and receive non-injected fuel. The selector valve is usually placed before the fuel filter, so that one filter can serve both tanks.

A typical selector valve 10 of the type used in the prior art is shown in FIG. 12. As shown therein, reversible electric motor 12 is connected to valve assembly 14 by screw drive 8 so that rotation of the motor in one direction causes engine feed and return lines 16 and 18 to be connected to feed and return lines 20 and 22 from tank 1, while rotation of the motor in the other direction connects the engine feed and return lines to feed and return lines 24 and 26 from tank 2. Electrical control of motor 12 is provided by means of a wiring harness (not shown) which is connected to selector valve 10 by male spade lugs 28 and by means of electrical contacts 30 and 32 which move with the screw drive and make contact with electrical contacts 34 and 36 carried by the selector valve housing.

Prior art fuel delivery systems of the above type have suffered a number of disadvantages. For example, vehicles equipped with such systems have exhibited fuel starvation problems when traveling over rough terrain, and, in particular, when traveling over steep inclines, even with as much as an eighth of a tank of gas left in the vehicle. This starvation problem is caused by a lack of fuel at the inlet to the low pressure pump due to sloshing of the fuel mass as a function of vehicle attitude and dynamics.

Various approaches have been considered for solving this fuel starvation problem. For example, it is possible to redesign the vehicle's gas tank so as to increase the probability that fuel will be present at the inlet to the low pressure pump. Such a redesign, however, can be very expensive, especially for a vehicle which is already in production. Also, due to design constraints imposed by safety, appearance and other considerations, for certain vehicles, fuel tank redesign will not completely solve the fuel starvation problem.

Alternatively, the fuel starvation problem can theoretically be eliminated by placing a reserve fuel mass between the low pressure pump and the high pressure pump so that the high pressure pump can continue to operate even though the low pressure pump is not receiving fuel from the gas tank. Unfortunately, in practice, this approach turns out to be unworkable. This is so because the high pressure pump supplies both the fuel injected into the vehicle's engine and the fuel returned to the vehicle's gas tank. Accordingly, to be able to supply the high pressure pump with fuel for periods of up to 5 minutes and longer, the reserve fuel mass would have to have a volume beyond that which can conveniently be incorporated into a standard truck or automobile.

Besides the fuel starvation problem, fuel-injected engines using the above type of fuel delivery system have also suffered from problems caused by air entrainment in the fuel stream fed to the injectors. Such entrainment is particularly severe after an episode of fuel starvation during which large amounts of air are introduced into the fuel delivery system through the low pressure pump. Such air entrainment results in loss of engine power and has been found to be one of the primary sources of rough engine idling.

In addition to the above problems which have plagued both one tank and two tank systems, the two tank systems, and, in particular, the selector valves used with those systems, have had their own special problems. Specifically, the use of an electric motor to actuate the valve has resulted in a complex, expensive, and delicate device.

As illustrated in FIG. 12, the prior art selector valves have required a multi-component drive train, composed of more than a dozen, intricate moving parts, to connect the electric motor to the valves. In addition, to actuate and control the motor has required even more parts, including complex and delicate electrical switching contacts as part of the valve itself and an electrical harness to connect the valve to the vehicle's main electrical system. Moreover, due to size and cost limitations, only small electric motors have been used in the prior art valves, and thus only small valve actuation forces have been achieved by these devices.

Plainly, in terms of ease of assembly, quality control testing, cost, and the overall effectiveness of the device, the prior art selector valves have been far from ideal.

SUMMARY OF THE INVENTION

In view of the foregoing state of the art, it is an object of this invention to provide improved routing systems for use with fuel-injected engines.

More particularly, it is an object of the invention to provide fuel routing systems which solve the fuel starvation problem without the need for adding a large fuel mass between the low pressure pump and the high pressure pump and without the need for redesigning the vehicle's gasoline tank.

It is a further object of the invention to provide fuel routing systems which automatically bleed entrained air from the fuel stream before that stream reaches the high pressure pump.

It is an additional object of the invention to provide a simplified selector valve for two tank systems which operates hydraulically using the pressures generated by the two low pressure pumps associated with the two fuel tanks.

It is another object of the invention to produce routing systems which achieve various combinations of the foregoing objects in a single, unitary device which can easily be made part of existing vehicle designs. In connection with this object, it is a further object of the invention to incorporate the fuel filter of prior art fuel delivery systems as part of the fuel routing device so that the objects of the invention can be achieved without increasing the total number of components making up the vehicle.

To achieve the foregoing and other objects, the invention in accordance with certain of its aspects provides fuel routing apparatus for use with a fuel delivery system which supplies fuel to an engine, said system including a fuel storage tank, a low pressure pump for withdrawing fuel from the storage tank, and a high pressure pump for delivering fuel to the engine, said fuel routing apparatus comprising:

(a) a reservoir;

(b) a first port leading to the reservoir for bringing fuel into the reservoir from the low pressure pump;

(c) a second port leading from the reservoir for delivering fuel to the high pressure pump;

(d) third and fourth ports connected to one another for returning fuel from the engine to the fuel storage tank; and (e) a valve connecting the third port to the reservoir, said valve being closed when the pressure difference between the pressure of the fuel in the third port and the pressure of the fuel in the reservoir is below a predetermined value, and said valve being open when said pressure difference is above the predetermined value so that the fuel returning from the engine through the third port is recycled to the engine by passing through the valve, the reservoir and the second port.

In accordance with certain preferred embodiments of these aspects of the invention, a bleed tube connecting the reservoir to the third port is provided for removing entrained air from the fuel before the fuel is delivered to the high pressure pump through the second port. In accordance with other preferred embodiments, the reservoir includes a filter for filtering the fuel before it is delivered to the high pressure pump through the second port. In connection with these latter preferred embodiments, the reservoir preferably includes a portion which can be removed for replacement of the filter, and the fuel routing apparatus preferably includes an anti-siphon valve between the first port and the reservoir to prevent siphoning of fuel from the storage tank during replacement of the filter.

In accordance with others of its aspects, the invention provides fuel routing apparatus for use with a fuel delivery system which supplies fuel to an engine, said system including first and second fuel storage tanks, first and second low pressure pumps for withdrawing fuel from the first and second storage tanks, respectively, and a high pressure pump for supplying fuel to the engine, said fuel routing apparatus comprising:

(a) first and second feed ports for receiving fuel from the first and second low pressure pumps, respectively;

(b) an engine feed port for delivering fuel to the high pressure pump;

(c) an engine return port for receiving fuel returned from the engine;

(d) first and second return ports for returning fuel to the first and second fuel storage tanks, respectively; and (e) hydraulically operated valve means having a first position in which the first feed port is connected to the engine feed port and the first return port is connected to the engine return port and a second position in which the second feed port is connected to the engine feed port and the second return port is connected to the engine return port, said means being responsive to the hydraulic pressures produced by the first and second low pressure pumps such that the means is in its first position when the first low pressure pump is supplying fuel to the first feed port and the second low pressure pump is not supplying fuel to the second feed port, and is in its second position when the second low pressure pump is supplying fuel to the second feed port and the first low pressure pump is not supplying fuel to the first feed port.

In accordance with certain preferred embodiments of these aspects of the invention, the hydraulically operated valve means comprises:

(a) a first two-position valve connecting the first feed port to the engine feed port when the valve is in its first position, and connecting the second feed port to the engine feed port when the valve is in its second position;

(b) a second two-position valve connecting the first return port to the engine return port when the valve is in its first position, and connecting the second return port to the engine return port when the valve is in its second position; and (c) a chamber separated into first and second portions by a diaphragm which is moveable between first and second positions corresponding to the first and second positions of the hydraulically operated valve means, said diaphragm being connected to said first and second two-position valves, the first and second two-position valves being in their first position when the diaphragm is in its first position and being in their second position when the diaphragm is in its second position, the first portion of the chamber being connected to the first feed port and the second portion of the chamber being connected to the second feed port so that the first portion fills with fuel and moves the diaphragm to its first position when the first low pressure pump is supplying fuel to the first feed port and the second low pressure pump is not supplying fuel to the second feed port, and the second portion fills with fuel and moves the diaphragm to its second position when the second low pressure pump is supplying fuel to the second feed port and the first low pressure pump is not supplying fuel to the first feed port. In accordance with these preferred embodiments of the invention, it is further preferred to provide the apparatus with detent means for defining the first and second positions of the diaphragm.

In the description of the preferred embodiments which appears below, the invention is described in the context of a routing system which incorporates all of the aspects of the present invention, that is, it incorporates the anti-fuel starvation aspect, the automatic bleed aspect, the filter in the reservoir aspect, and the hydraulic selector valve aspect. It is to be understood that the various aspects of the invention can be used in combinations other than those illustrated. For example, the anti-fuel starvation aspect is equally applicable to vehicles having one, instead of two, fuel tanks. Similarly, the hydraulic selector valve aspect can be used without also using the anti-fuel starvation aspect. Accordingly, it is to be understood that both the foregoing general description and the following detailed description are explanatory only and are not restrictive of the invention.

The accompanying drawings, which are incorporated in and constitute part of the specification, illustrate the preferred embodiments of the invention, and together with the description, serve to explain the principles of the invention.

DESCRIPTION OF THE PREFERRED EMBODIMENTS

Figure 1:
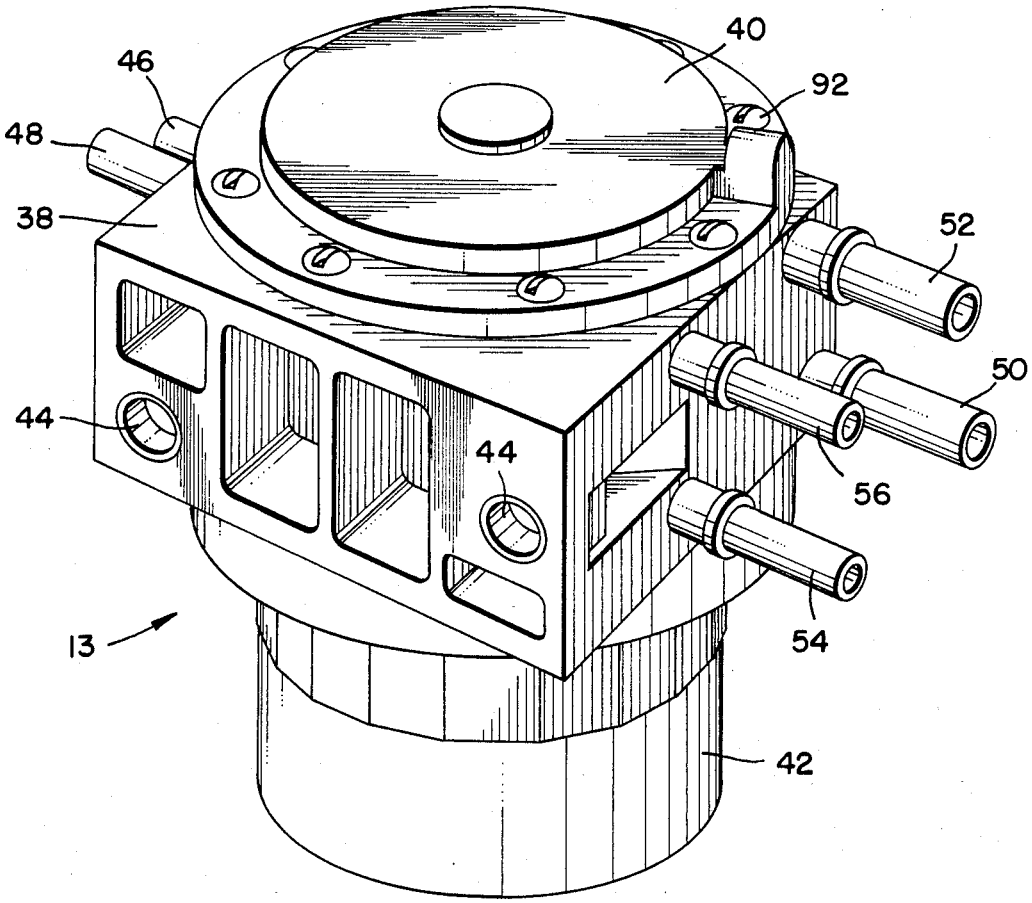
FIG. 1 is a perspective view of the fuel routing apparatus of the present invention.

With reference now to the drawings, wherein like reference characters designate like or corresponding parts throughout the several views, there is shown in FIG. 1 a perspective view of a two-tank selector valve 13 incorporating the inventive features of the present invention. Valve 13 includes body 38 to which are attached cover 40 and screw-on reservoir/filter cup 42. Body 38 is provided with apertures 44 for mounting the valve to the vehicle's frame through the use of conventional mounting bolts or the like. Body 38, cover 40, and cup 42 are preferably made of polyester thermoplastics, and are preferably formed by injection molding, although other formation techniques and other materials which will not deteriorate in the presence of gasoline or other engine fuels can be used.

Six ports, identified by reference numerals 46 through 56, lead into and through body 38. Ports 46 and 48 are the engine feed and return ports, respectively. Fuel from valve 13 passes out of engine feed port 46, through a high pressure pump (not shown), and to the vehicle's engine (not shown). Fuel returning from the engine enters valve 13 through engine return port 48. Typically, the returning fuel will be at a pressure of approximately 2 psi.

Ports 50 and 52 are the first and second feed ports which receive fuel from the low pressure pumps (not shown) associated with the vehicle's first and second fuel storage tanks (not shown). In a typical configuration, each fuel tank is equipped with an electric pump. The operator selects the tank which is to supply fuel to the engine by means of a switch located in the vehicle cab which selectively activates one or the other of the two low pressure pumps. When in operation, the low pressure pump supplies fuel to valve 13 at a pressure of between about 3 and about 6 psi.

Ports 54 and 56 are the first and second return ports through which fuel is returned to the vehicle's first and second fuel storage tanks. As will now be described, selector valve 13 hydraulically senses which of the vehicle's two low pressure pumps is active and then automatically couples the engine feed and return ports 46 and 48 to the feed and return ports (either 50 and 54 or 52 and 56) associated with that pump.

Figure 10:
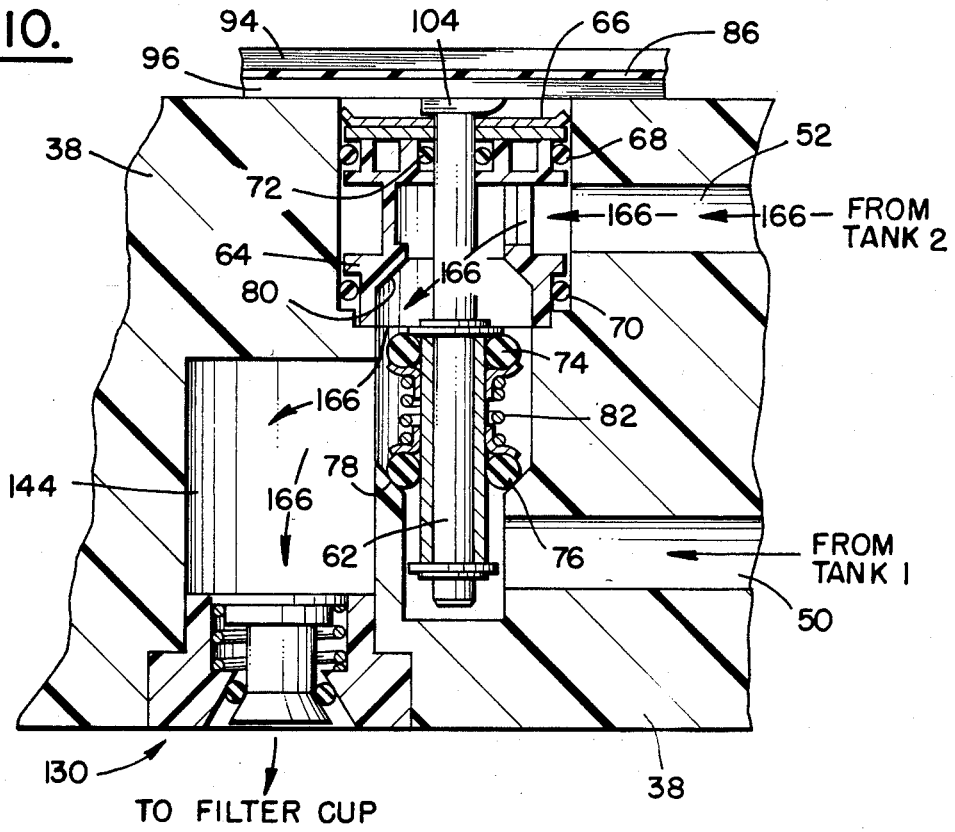
FIG. 10 is a partial cross-sectional view along the same lines as FIG. 6 showing inflow of fuel to the apparatus from the vehicle's second fuel storage tank.
Figure 12:
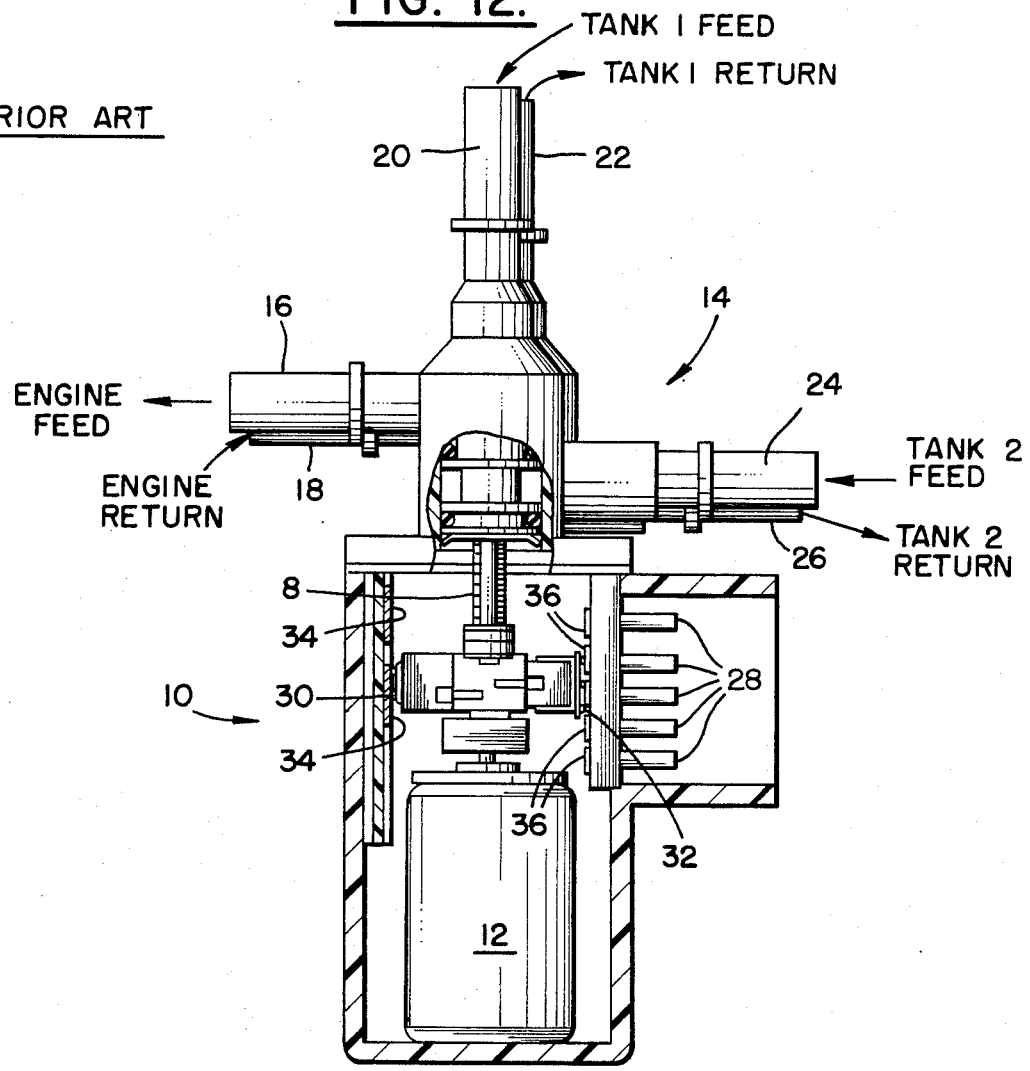
FIG. 12. PRIOR ART
FIG. 12 shows a prior art selector valve, partially in section.

The hydraulic switching between tanks is accomplished by means of first and second two-position valves 58 and 60 (the "feed" and "return" two-position valves, respectively). These valves can be of the type used in prior art selector valves such as the prior art selector valve shown in FIG. 12. As can be seen most clearly in FIG. 10, each valve includes a movable shaft 62 and a fixed housing 64. Housing 64 is held in place within body 38 of selector valve 13 by means of retaining ring 66. A seal between housing 64 and body 38 is provided by O-rings 68 and 70. A seal between housing 64 and shaft 62 is provided by O-ring 72.

Flow through the valve is a function of the position of shaft 62. When shaft 62 is in its lower position, flow through the lower portion of the valve is stopped by means of O-ring 76 contacting shoulder 78 formed in body 38. When shaft 62 is in its upper position, flow through the upper portion of the valve is stopped by means of O-ring 74 contacting shoulder 80 formed in housing 64. Spring 82 forces O-rings 74 and 76 outward so that a tight seal is achieved between the O-rings and their respective mating shoulders.

Figure 6:
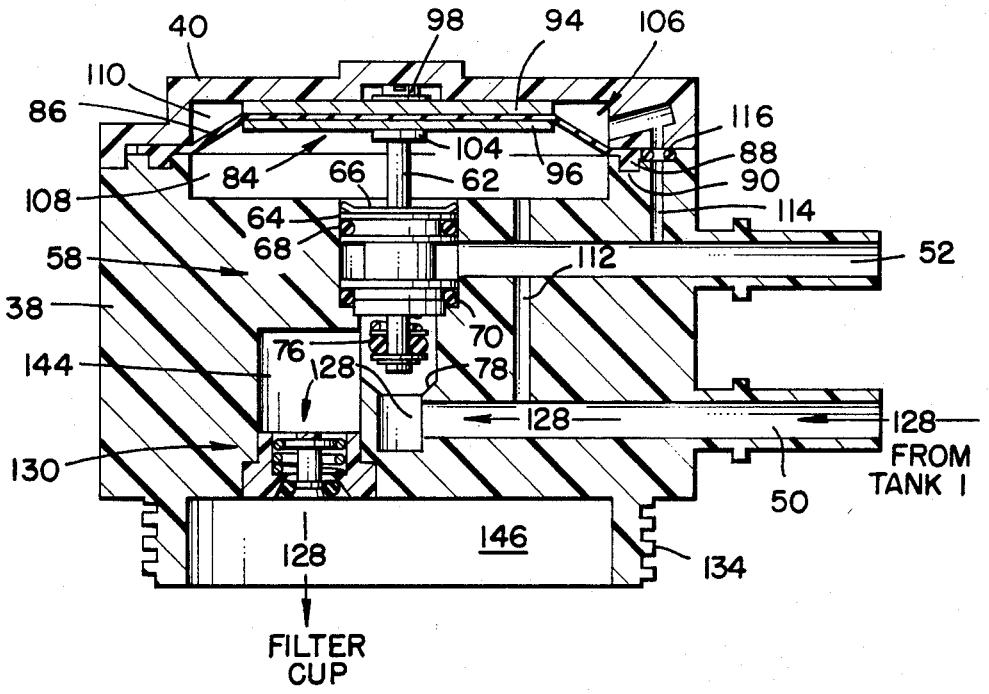
FIG. 6 is a cross-sectional view along lines 6—6 in FIG. 2 showing inflow of fuel to the apparatus from the vehicle's first fuel storage tank.

Feed two-position valve 58 determines whether engine feed port 46 receives fuel from first feed port 50 or from second feed port 52 (see FIG. 6). When valve 58 is in its upper or first position, fuel is provided from feed port 50; when the valve is in its lower or second position, fuel is provided from feed port 52. Similarly, return two-position valve 60 determines whether fuel is returned to the first fuel tank through first return port 54 or to the second fuel tank through second return port 56 (see FIG. 8). When valve 60 is in its upper or first position, fuel is returned through return port 54; when valve 60 is in its lower or second position, fuel is returned through return port 56.

Figure 2:
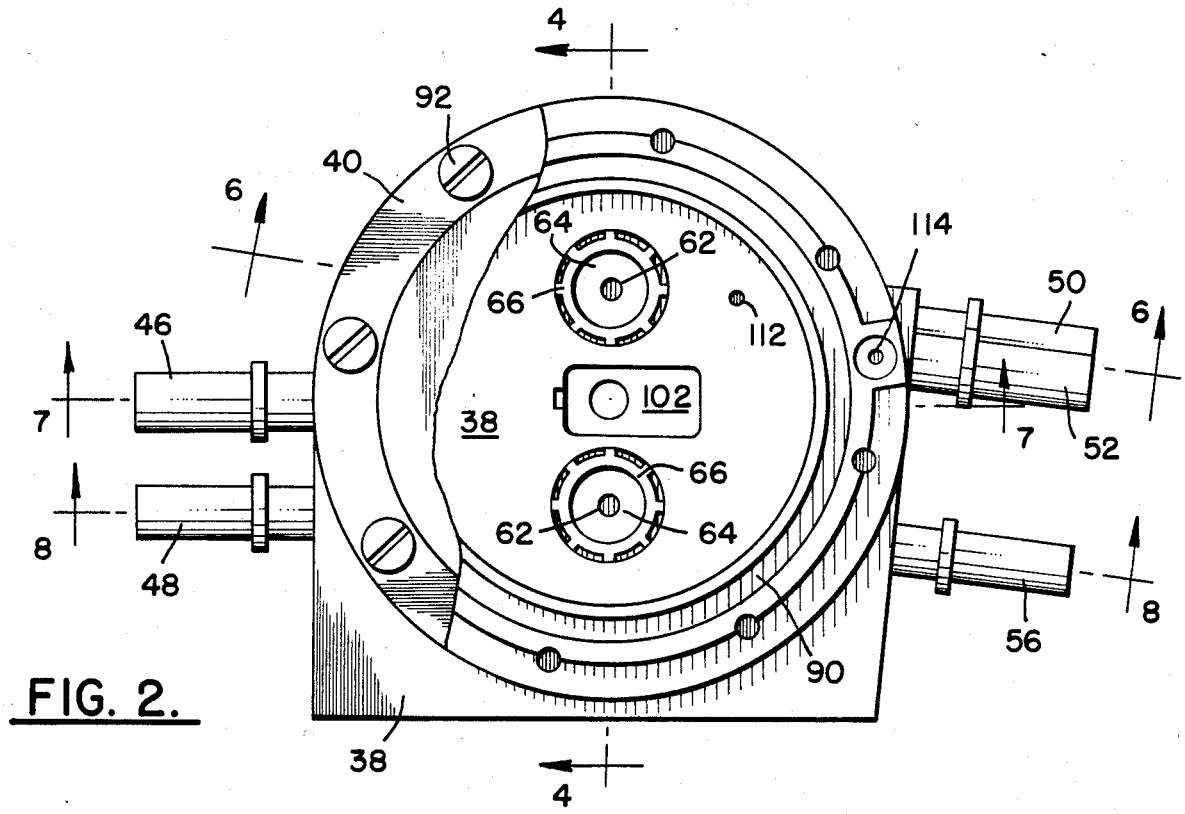
FIG. 2 is top plan view of the fuel routing apparatus of FIG. 1 with the diaphragm assembly removed and part of the top cover of the apparatus broken away to show the internal arrangement of the two-position valves.
Figure 4:
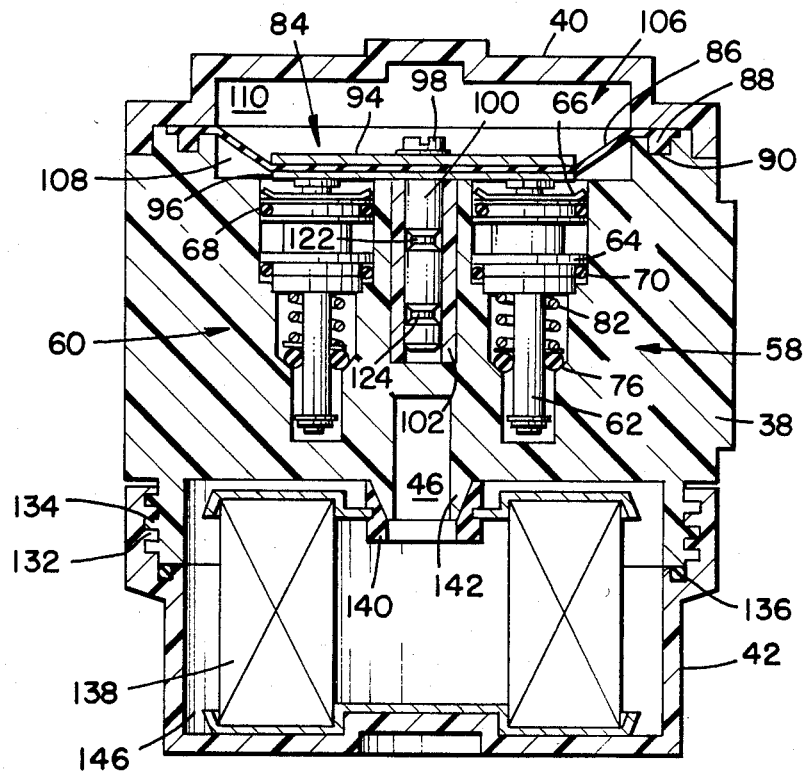
FIG. 4 is a cross-sectional view along lines 4—4 in FIG. 2 showing the two-position valves in their lower or second positions.
Figure 3:
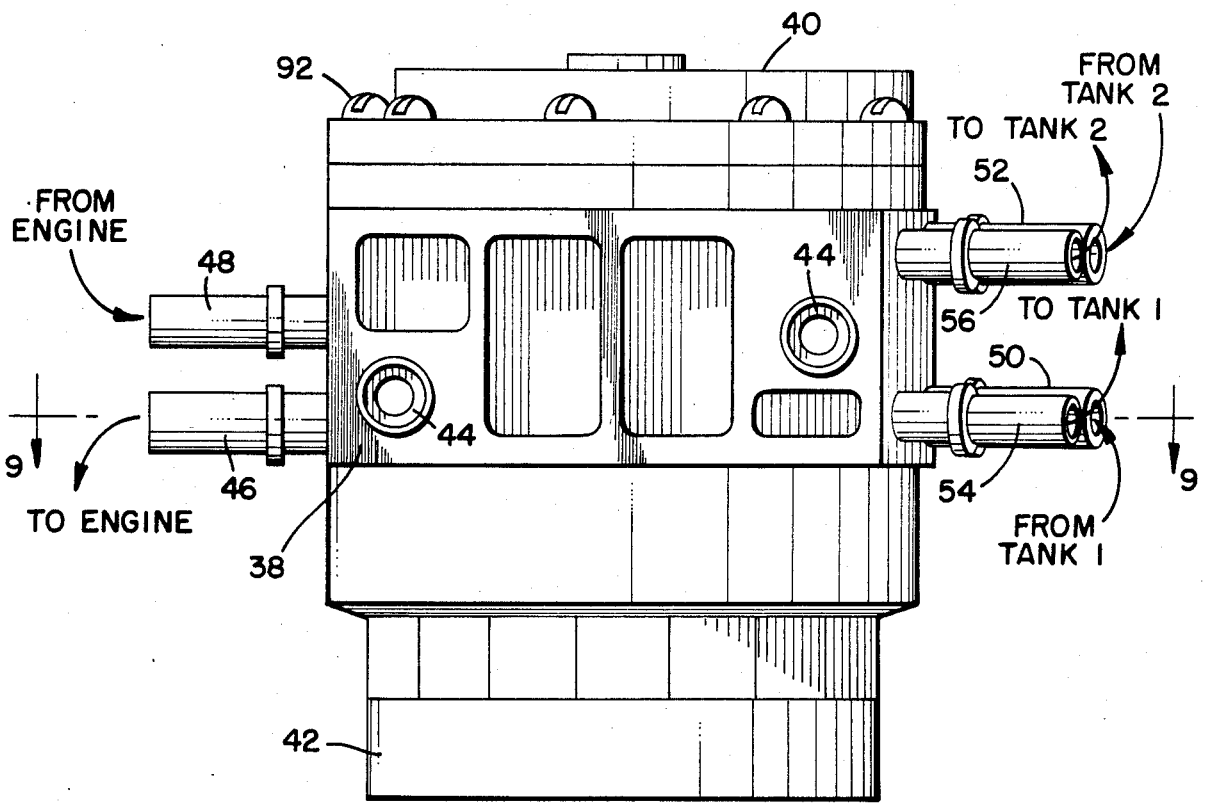
FIG. 3 is a front plan view of the fuel routing apparatus of FIG. 1.
Figure 5:
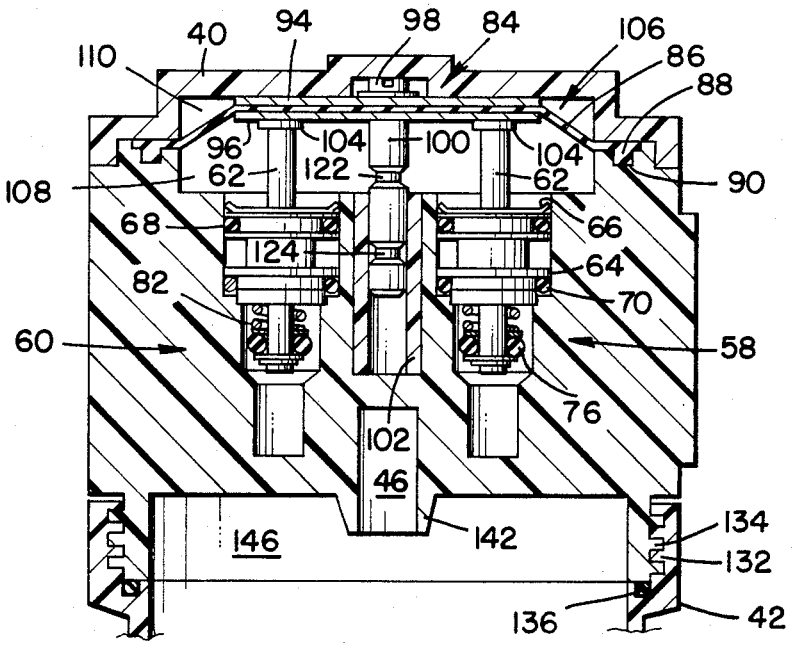
FIG. 5 is a cross-sectional view along the same lines as those of FIG. 4 showing the two-position valves in their upper or first positions.

The positions of valves 58 and 60 are determined by the position of diaphragm assembly 84. As can be seen most clearly in FIGS. 4–8, diaphragm assembly 84 includes flexible diaphragm 86 which is clamped along its periphery between cover 40 and body 38. To facilitate this clamping, diaphragm 86 preferably includes a ridge 88 which is received in a groove 90 formed in body 38. As shown in FIGS. 1–3, cover 40 is firmly attached to body 38 by means of screws 92, although other means of attachment can be used as desired. Diaphragm 86 is preferably made of a material such as fluorosilicone, although other flexible materials which will not deteriorate when bathed in gasoline or other engine fuels can be used.

The center portion of diaphragm 86 is sandwiched between metal discs 94 and 96. The discs and the diaphragm are held together by screw 98 which threads into shaft 100. As described in detail below shaft 100 is received in detent assembly 102, which itself is received in body 38.

Two-position valves 58 and 60 are attached to metal disc 96 by means of shafts 62 being received in locking grooves 104 formed in the disc. In this way, the valves move in unison with diaphragm 86.

As can be seen most clearly in FIG. 6, diaphragm 86 sits in chamber 106 formed between cover 40 and body 38. The diaphragm divides the chamber into first and second portions 108 and 110. First portion 108 is connected to first feed port 50 by port 112 formed in body 38; second portion 110 is connected to second feed port 52 by port 114 formed in body 38 and cover 40. O-ring 116 assists in sealing cover 40 to body 38 in the region of port 114.

By means of ports 112 and 114, diaphragm 86 moves as a function of which of the vehicle's two low pressure pumps is active. Specifically, when the operator selects the vehicle's first storage tank as the source for fuel, the first low pressure pump is active and fuel flows through first feed port 50, into port 112, and fills first portion 108 of chamber 106. This causes diaphragm 86 to move to its upper or first position, thus causing two-position valves 58 and 60 to be in their upper or first positions. Conversely, when the operator selects the vehicle's second storage tank as the source for fuel, the second low pressure pump is active and fuel flows through second feed port 52, into port 114, and fills second portion 110 of chamber 106. This causes diaphragm 86 to move to its lower or second position, thus causing two-position valves 58 and 60 to be in their lower or second positions. In this way, selector valve 13 automatically performs hydraulic switching between the fuel tanks of a two-fuel tank vehicle.

To stabilize diaphragm 86 in its first and second positions, selector valve 13 preferably includes detent assembly 102. As shown most clearly in FIG. 7, this assembly includes body 118 with houses spring 126 which urges ball 120 against shaft 100. Shaft 100 includes detents 122 and 124 which engage ball 120. In this way, diaphragm 86 does not change position when the engine is turned off, during periods of fuel starvation or during pressure pulses, but only when there is a change in the low pressure pump which is active.

Figure 11:
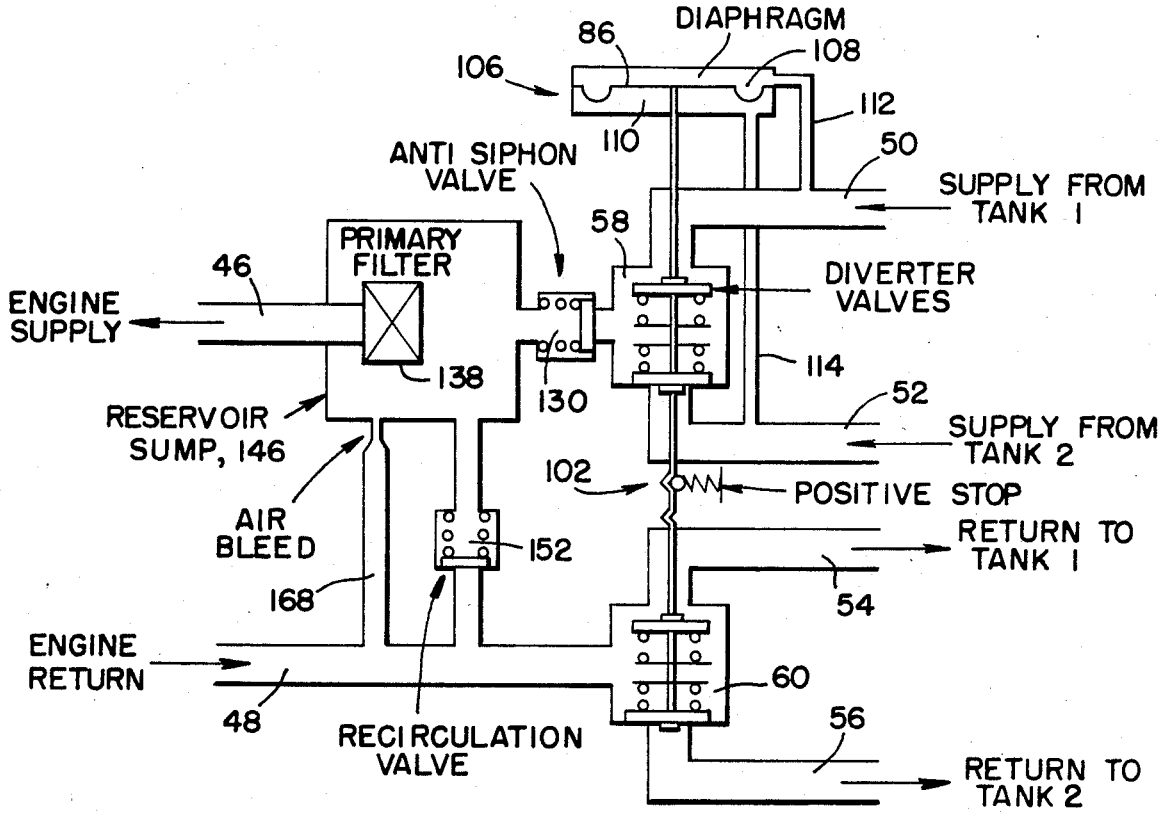
FIG. 11 is a schematic diagram of the fuel routing apparatus.

With the foregoing in mind, the overall operation of the hydraulic selector valve aspects of the invention can readily be seen by reference to the hydraulic schematic of FIG. 11 and the cross-sectional views of FIGS. 6–10. As shown by arrows 128 in FIG. 6, when the low pressure pump associated with the first fuel tank is active, fuel enters feed port 50, passes into common port 144, passes through anti-siphon valve 130, and finally enters filter cup 42. As shown most clearly in FIG. 4, filter cup 42 is threaded onto body 38 by means of mating threads 132 and 134 on the cup and the body, respectively. O-ring 136 assists in forming a tight seal between filter cup 42 and body 38.

Filter cup 42 houses filter 138 and serves as the removable portion of fuel reservoir 146. Filter 138 preferably includes a tapered grommet 140 which mates with a corresponding cone-shaped fitting 142 formed in body 38 so as to produce a positive seal between the filter and the body in the region of engine feed port 46. Anti-siphon valve 130 allows filter 138 to be changed without siphoning of gas from the vehicle's storage tanks. This valve is in a closed state when the vehicle's low pressure pumps are not in operation, as would be the case when the filter is being changed. For low pressure pumps producing pressures at feed ports 50 and 52 of the magnitudes described above, valve 130 preferably remains closed until the pressure difference between common port 144 and reservoir 146 is greater than about 0.5 psi.

Figure 7:
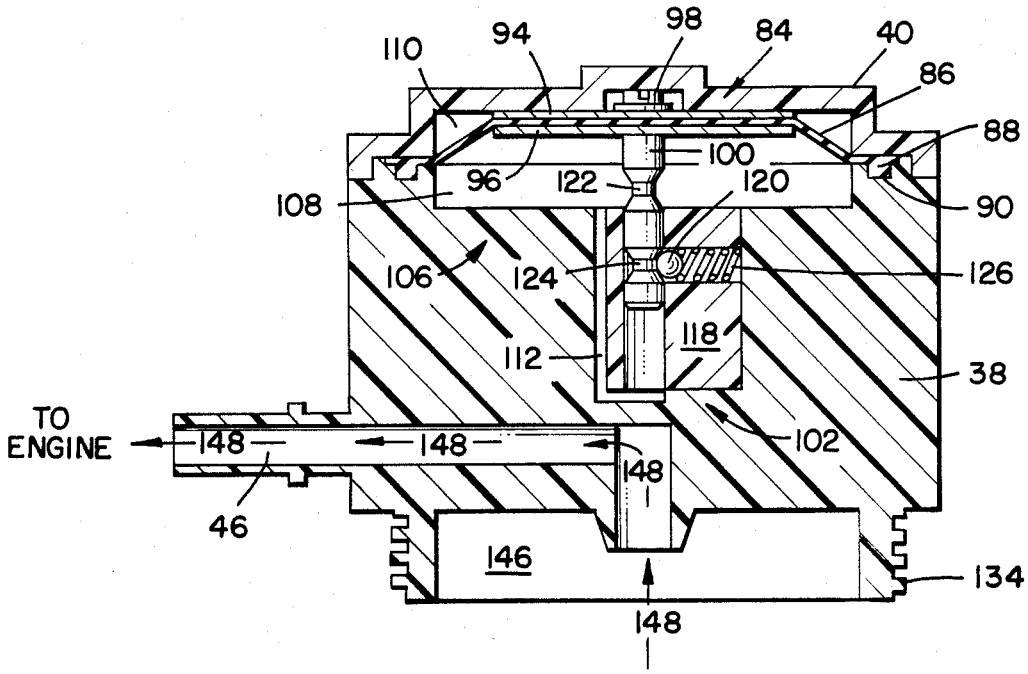
FIG. 7 is a cross-section view along lines 7—7 in FIG. 2 showing outflow of fuel from the apparatus to the vehicle's engine.

After passing through anti-siphon valve 130 and entering reservoir 146, the fuel passes through filter 138 and into engine feed port 46 (see arrows 148 in FIG. 7). Fuel which is not injected into the engine is returned to selector valve 13 as shown by arrows 150 in FIG. 8. Depending upon whether or not there is a fuel starvation problem, the fuel will then either pass through recycling valve 152 (see arrows 154 in FIG. 8) or through return valve 60 and back to the first fuel storage tank through first return port 54 (see arrows 156 in FIG. 8). The fuel flow patterns are essentially the same when the low pressure pump associated with the second fuel storage tank is active except that the fuel enters valve 13 through feed port 52 (see arrows 166 in FIG. 10) and returns to the storage tank through return port 56.

Figure 8:
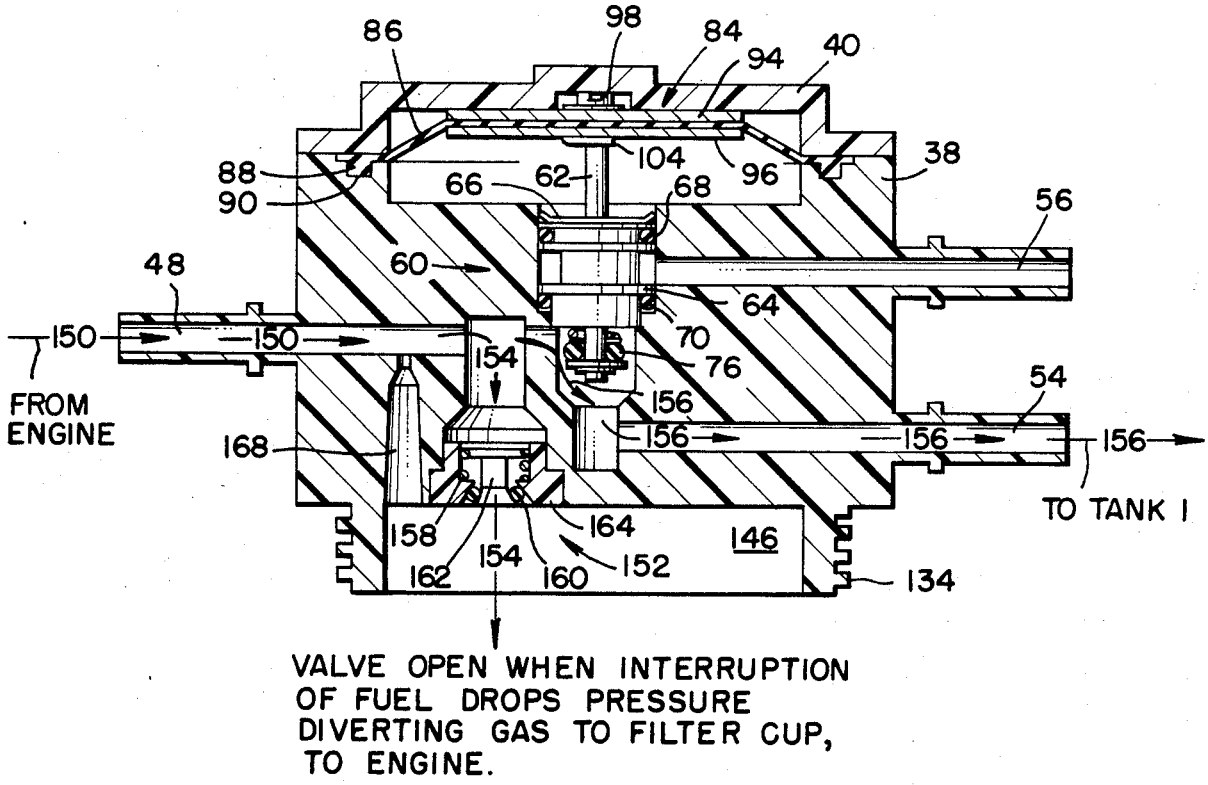
FIG. 8 is a cross-section view along lines 8—8 in FIG. 2 showing the return of fuel to the apparatus from the vehicle's engine.
Figure 9:
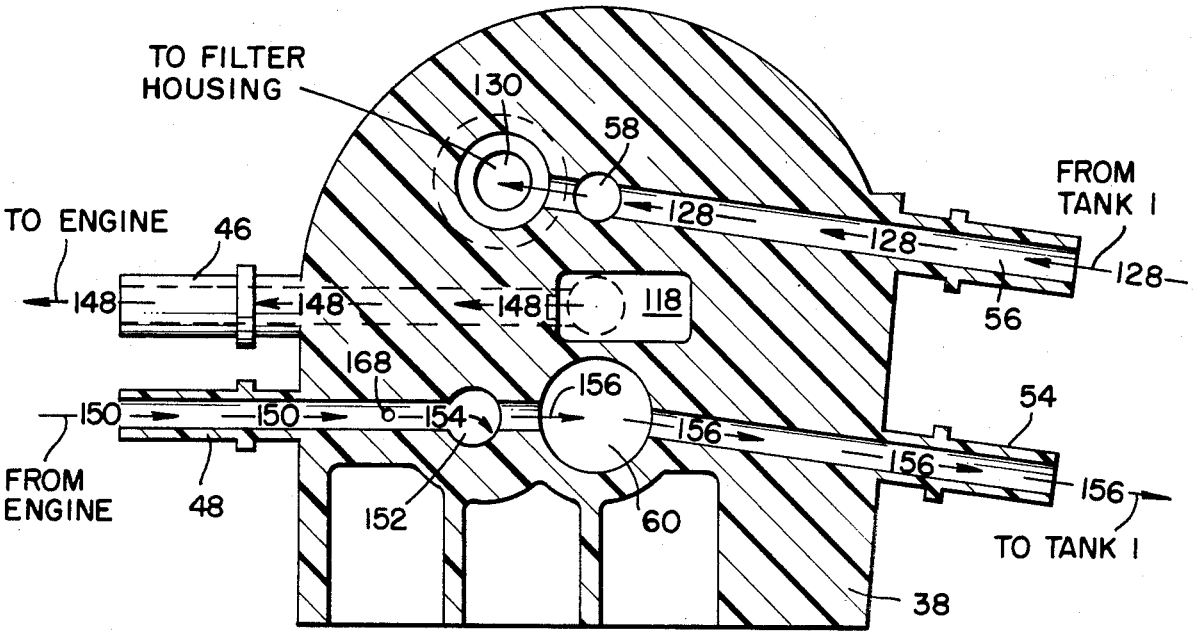
FIG. 9 is a cross-section view along lines 9—9 in FIG. 3 showing fuel routing to and from both the vehicle's first fuel storage tank and the vehicle's engine.

The recycling aspects of the invention are achieved by means of recycling valve 152 which connects engine return port 48 to reservoir 146. As shown in FIG. 8, valve 152 includes spring 158 which moves valve core 162 relative to valve housing 164 so that O-ring 160 closes off the space between the core and the housing and thus closes the valve. Valve 152 is normally closed; it only open when the pressure difference across the valve is sufficient to overcome the force of spring 158. Valve constructions other than that shown in FIG. 8 of course can be used.

Whether valve 152 is open or closed depends on the pressure differences between the pressure in engine return port 48 and the pressure in reservoir 146. When that pressure difference is small or is negative (i.e., the pressure in the reservoir is above the pressure in the port), the valve is closed. When the pressure difference is large enough, the valve opens.

During normal engine operation, valve 152 is closed because the pressure in reservoir 146 created by the vehicle's low pressure pump is greater than the pressure of the fuel returning from the engine. For example, for a typical fuel-injected gasoline engine, the pressure in reservoir 146 will be on the order of approximately 3–6 psi, while the pressure in engine return port 48 will be on the order of approximately 2 psi, that is, there will be a negative pressure difference across the valve of approximately 1–4 psi.

During fuel starvation, however, the low pressure pump is no longer supplying fuel to reservoir 146, and thus the pressure in the reservoir drops. Eventually, valve 152 opens allowing returning fuel to be recycled back to the engine. In practice, it has been found convenient to use valves which open when the pressure difference between port 48 and reservoir 146 is about 0.5 psi, although valves which open at other pressures can be used. For a pressure of about 2 psi in engine return port 48, this means that valve 152 will open when the pressure in reservoir 146 drops to about 1.5 psi.

When the fuel starvation episode has ended, the low pressure pump will again supply fuel to selector valve 13 and thus the pressure in reservoir 146 will rise. Eventually recycling valve 152 will close and fuel returning from the engine will be routed back to the vehicle's fuel storage tank.

This cessation of recirculation is important since long term recirculation may cause overheating and vaporization of the fuel. Specifically, it has been found that the fuel starvation problem cannot be overcome by a routing system which does not return fuel to the vehicle's fuel tank during normal operation. That is, the fuel starvation problem cannot be overcome by a routing system in which fuel is fed from the low pressure pump to an intermediate reservoir and then continuously cycled from the reservoir to the high pressure pump, to the engine, and back to the reservoir. In such a system, the temperature of the fuel increases with each passage through the engine, eventually resulting in fuel vaporization. Since vaporized fuel is pumped only poorly by the high pressure pump and since the injection of other than liquid fuel into the engine gives other than the optimum fuel mixture, the engine either runs poorly or stalls once vaporization occurs. The routing system of the present invention does not suffer from this vaporization problem because recycling of the fuel does not occur during normal operation, but only when the low pressure pump is not sending fuel to the reservoir.

It has been found that for a reservoir having a capacity of approximately 100–150 cc, the fuel recycling system of the present invention will sustain engine operation for periods of time greater than 5 minutes without any fuel being delivered to the reservoir from the low pressure pump. Such a small reservoir is able to achieve such long periods of operation since only the fuel actually injected into the engine has to be supplied by the reservoir, not the total amount of fuel passing through the high pressure pump. Also, the fuel mass in the high pressure pump and in the various feed and return lines connecting that pump to valve 13 and to the injectors serve as an additional fuel reservoir for sustained engine operation.

Bleeding of entrained air from the fuel stream being supplied to the high pressure pump through engine feed port 46 is achieved by means of bleed tube 168. As shown in FIG. 8, this tube connects reservoir 146 to engine return port 48. At its opening to port 48, the bleed tube preferably has a diameter of approximately 1.0 mm, although larger and smaller apertures can be used. For vehicles having only one fuel tank, bleed tube 168 need not be connected to the engine return port but can be connected to the tank return port.

From the foregoing, it is evident that the present invention provides a robust, unitary device which simultaneously solves the fuel starvation problem, bleeds entrained air from the fuel stream, filters the fuel stream, and performs automatic fuel routing for multiple fuel tank vehicles.

What is claimed is:

1. Fuel routing apparatus for use with a fuel delivery system which supplies fuel to an engine, said system including first and second fuel storage tanks, first and second low pressure pumps for withdrawing fuel from the first and second storage tanks, respectively, and a high pressure pump or supplying fuel to the engine, said apparatus comprising:

(a) first and second feed ports for receiving fuel from the first and second low pressure pumps, respectively;

(b) an engine feed port for delivering fuel to the high pressure pump;

(c) an engine return port for receiving fuel returned from the engine;

(d) first and second return ports for returning fuel to the first and second fuel storage tanks, respectively; and (e) hydraulically operated valve means having a first position in which the first feed port is connected to the engine feed port and the first return port is connected to the engine return port and a second position in which the second feed port is connected to the engine feed port and the second return port is connected to the engine return port, said means being responsive to the hydraulic pressures produced by the first and second low pressure pumps such that the means is in its first position when the first low pressure pump is supplying fuel to the first feed port and the second low pressure pump is not supplying fuel to the second feed port, and is in its second position when the second low pressure pump is supplying fuel to the second feed port and the first low pressure pump is not supplying fuel to the first feed port, said hydraulically operated valve means comprising:

(i) a first two-position valve connecting the first feed port to the engine feed port when the valve is in its first position, and connecting the second feed port to the engine feed port when the valve is in its second position;

(ii) a second two-position valve connecting the first return port to the engine return port when the valve is in its first position, and connecting the second return port to the engine return port when the valve is in its second position; and (iii) a chamber separated into first and second portions by a diaphragm which is moveable between first and second positions corresponding to the first and second positions of the hydraulically operated valve means, said diaphragm being connected to said first and second two-position valves, the first and second two-position valves being in their first position when the diaphragm is in its first position and being in their second position when the diaphragm is in its second position, the first portion of the chamber being connected to the first feed port and the second portion of the chamber being connected to the second feed port so that the first portion fills with fuel and moves the diaphragm to its first position when the first low pressure pump is supplying fuel to the first feed port and the second low pressure pump is not supplying fuel to the second feed port, and the second portion fills with fuel and moves the diaphragm to its second position when the second low pressure pump is supplying fuel to the second feed port and the first low pressure pump is not supplying fuel to the first feed port.

2. The fuel routing apparatus of claim 1 wherein said hydraulically operated valve means includes detent means for defining the first and second positions of said diaphragm.

3. The fuel routing apparatus of claim 1 further including:

(a) a reservoir connected to said engine feed port, said feed port being connected to said reservoir when said hydraulically operated valve means is in its first position, and said second feed port being connected to said reservoir when said hydraulically operated valve means is in its second position; and (b) a valve connecting the engine return port to the reservoir, said valve being closed when the pressure difference between the pressure of the fuel in the engine return port and the pressure of the fuel in the reservoir is below a predetermined value, and said valve being open when said pressure difference is above the predetermined value, the fuel returning through the engine return port being recycled to the engine through the reservoir and the engine feed port when the valve is open.

4. The fuel routing apparatus of claim 3 further including a bleed tube connecting the reservoir to the engine return port for removing entrained air from the fuel being delivered to the high pressure pump through the engine feed port.

5. The fuel routing apparatus of claim 3 wherein the reservoir includes a filter for filtering the fuel before it is delivered to the high pressure pump through the engine feed port.

6. The fuel routing apparatus of claim 5 wherein the reservoir includes first and second portions, the first portion being removable from the second portion for replacement of the filter, and wherein the first and second feed ports are connected to the reservoir by a common port and said common port includes a valve which is closed when neither the first nor the second low pressure pumps is in operation so as to prevent siphoning of fuel from either of the two storage tanks during replacement of the filter.

7. Fuel routing apparatus for use with a fuel delivery system which supplies fuel to an engine, said system including first and second fuel storage tanks, first and second low pressure pumps for withdrawing fuel from the first and second storage tanks, respectively, and a high pressure pump for supplying fuel to the engine, said apparatus comprising:

(a) first and second feed ports for receiving fuel from the first and second low pressure pumps, respectively;

(b) an engine feed port for delivering fuel to the high pressure pump;

(c) an engine return port for receiving fuel returned from the engine;

(d) first and second return ports for returning fuel to the first and second fuel storage tanks, respectively;

(e) a reservoir connected to said engine feed port;

(f) a filter within the reservoir for filtering the fuel before it is delivered to the high pressure pump through the engine feed port;

(g) a bleed tube connecting the reservoir to the engine return port for removing entrained air from the fuel being delivered to the high pressure pump through the engine feed port;

(h) a first two-position valve connecting the first feed port to the reservoir when the valve is in its first position, and connecting the second feed port to the reservoir when the valve is in its second position;

(i) a second two-position valve connecting the first return port to the engine return port when the valve is in its first position, and connecting the second return port to the engine return port when the valve is in its second position;

(j) a chamber separated into first and second portions by a diaphragm which is moveable between first and second positions, said diaphragm being connected to said first and second two-position valves, the first and second two-position valves being in their first position when the diaphragm is in its first position and being in their second position when the diaphragm is in its second position, the first portion of the chamber being connected to the first feed port and the second portion of the chamber being connected to the second feed port so that the first portion fills with fuel and moves the diaphragm to its first position when the first low pressure pump is supplying fuel to the first feed port and the second low pressure pump is not supplying fuel to the second feed port, and the second portion fills with fuel and moves the diaphragm to its second position when the second low pressure pump is supplying fuel to the second feed port and the first low pressure pump is not supplying fuel to the first feed port; and (k) a valve connecting the engine return port to the reservoir, said valve being closed when the pressure difference between the pressure of the fuel in the engine return port and the pressure of the fuel in the reservoir is below a predetermined value, and said valve being open when said pressure difference is above the predetermined value, the fuel returning through the engine return port being recycled to the engine through the reservoir and the engine feed port when the valve is open.

8. The fuel routing apparatus of claim 7 including detent means which define the first and second positions of said diaphragm.

9. The fuel routing apparatus of claim 8 wherein the reservoir includes first and second portions, the first portion being removable from the second portion for replacement of the filter, and wherein the first and second feed ports are connected to the reservoir by a common port and said common port includes a valve which is closed when neither the first nor the second low pressure pump is in operation so as to prevent siphoning of fuel from the storage tanks during replacement of the filter.

10. Fuel routing apparatus for use with a fuel delivery system which supplies fuel to an engine, said system including first and second fuel storage tanks and first and second pumps for withdrawing fuel from the first and second storage tanks, respectively, said apparatus comprising:

(a) first and second feed ports for receiving fuel from the first and second pumps, respectively;

(b) an engine feed port for delivering fuel to the engine;

(c) an engine return port for receiving fuel returned from the engine.

(d) first and second return ports for returning fuel to the first and second fuel storage tanks, respectively; and (e) hydraulically operated valve means having a first position in which the first feed port is connected to the engine feed port and the first return port is connected to the engine return port and a second position in which the second feed port is connected to the engine feed port and the second return port is connected to the engine return port, said means being responsive to the hydraulic pressures produced by the first and second pumps such that the means is in its first position when the first pump is supplying fuel to the first feed port and the second pump is not supplying fuel to the second feed port, and is in its second position when the second pump is supplying fuel to the second feed port and the first pump is not supplying fuel to the first feed port, said hydraulically operated valve means comprising:

(i) a first two-position valve connecting the first feed port to the engine feed port when the valve is in its first position, and connecting the second feed port to the engine feed port when the valve is in its second position;

(ii) a second two-position valve connecting the first return port to the engine return port when the valve is in its first position, and connecting the second return port to the engine return port when the valve is in its second position; and (iii) a chamber separated into first and second portions by a diaphragm which is moveable between first and second positions corresponding to the first and second positions of the hydraulically operated valve means, said diaphragm being connected to said first and second two-position valves, the first and second two-position valves being in their first position when the diaphragm is in its first position and being in their second position when the diaphragm is in its second position, the first portion of the chamber being connected to the first feed port and the second portion of the chamber being connected to the second feed port so that the first portion fills with fuel and moves the diaphragm to its first position when the first pump is supplying fuel to the first feed port and the second pump is not supplying fuel to the second feed port, and the second portion fills with fuel and moves the diaphragm to its second position when the second pump is supplying fuel to the second feed port and the first pump is not supplying fuel to the first feed port.

11. The fuel routing apparatus of claim 10 wherein said hydraulically operated valve means includes detent means for defining the first and second positions of said diaphragm.

* * * * *